US006641022B2

(12) United States Patent
Hamano et al.

(10) Patent No.: US 6,641,022 B2
(45) Date of Patent: Nov. 4, 2003

(54) NAILING MACHINE

(75) Inventors: Terufumi Hamano, Tokyo (JP); Takahiro Nagaoka, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/360,625

(22) Filed: Feb. 10, 2003

(65) Prior Publication Data

US 2003/0127490 A1 Jul. 10, 2003

Related U.S. Application Data

(62) Division of application No. 09/758,139, filed on Jan. 12, 2001, now Pat. No. 6,592,016.

(30) Foreign Application Priority Data

Jan. 13, 2000 (JP) ..... P2000-5057
Jan. 13, 2000 (JP) ..... P2000-5058

(51) Int. Cl.[7] ..... B25C 1/04
(52) U.S. Cl. ..... 227/120; 227/136
(58) Field of Search ..... 227/120, 136, 227/135, 119, 109

(56) References Cited

U.S. PATENT DOCUMENTS

| | | | | |
|---|---|---|---|---|
| 3,037,207 A | | 6/1962 | Pazan | 1/44.4 |
| 3,615,049 A | * | 10/1971 | Obergfell et al. | 227/8 |
| 4,197,974 A | * | 4/1980 | Morton et al. | 227/120 |
| 5,335,800 A | * | 8/1994 | Liu | 227/120 |
| 5,433,367 A | | 7/1995 | Liu | 227/120 |
| 5,816,469 A | | 10/1998 | Ohuchi | 227/119 |
| 5,975,400 A | | 11/1999 | Yang | 227/120 |
| 6,032,848 A | | 3/2000 | Smolinski | 227/119 |
| 6,053,389 A | | 4/2000 | Chu et al. | 227/120 |
| 6,056,181 A | | 5/2000 | Chuang | 227/8 |
| 6,199,739 B1 | * | 3/2001 | Mukoyama et al. | 227/120 |
| 6,290,115 B1 | * | 9/2001 | Chen | 227/120 |
| 6,371,348 B1 | * | 4/2002 | Canlas et al. | 227/120 |

FOREIGN PATENT DOCUMENTS

TW 242813 3/1995

OTHER PUBLICATIONS

Taiwanese Office Action dated Aug. 5, 2002.
English translation of Taiwanese Office Action dated Aug. 5, 2002.

* cited by examiner

*Primary Examiner*—Scott A. Smith
(74) *Attorney, Agent, or Firm*—Morgan, Lewis & Bockius LLP

(57) ABSTRACT

A fixing pin is attached to a winding end of a spring attached to a pusher of a nailing machine. A fixing plate with an engaging hole is engaged with the fixing pin from the outside of an opening of a magazine. The fixing pin is guided to a tapering section of the opening by moving the fixing plate in the direction of a nose section of the nailing machine to fix the fixing plate. Further, a magazine has a guide groove for guiding a T-shaped top portion formed at an upper end of the pusher and for guiding head portions of connected nails in an upper portion of a guide path of the pusher and the connected nails. A cover made of iron is attached to the inside of the guide groove. Thickness of a part of the pusher is smaller than the diameter of nail axis portions.

1 Claim, 8 Drawing Sheets

NAILING MACHINE

"This is a divisional of copending application Ser. No. 09/758,139, filed Jan. 12, 2001, now U.S. Pat. No. 6,592,016."

BACKGROUND OF THE INVENTION

1. Field of the Invention

The present invention relates to a structure of a nailing machine. Especially, the present invention relates to a structure for mounting a spring (spiral spring) for a pusher of a nailing machine in which the spring for pushing the pusher in the direction of a nose section can be easily replaced. Further, the present invention relates to a structure of a guide for a pusher of a magazine of a nailing machine for guiding the pusher to push connected nails charged into the magazine in the longitudinal direction of the magazine.

2. Description of the Related Art

Conventionally, a spring (spiral spring) for pushing a pusher in the direction of a nose is fixed to a magazine with the following. A fixing pin is attached to a winding end section of the spring. In order to install the winding end of the spring into a magazine, a head portion of the fixing pin is protruded from an opening formed on a wall face of the magazine. The profile of the opening is formed being tapered in such a manner that the width on the side of a nose section is wide and the width on the side opposite to the nose section is narrow. Then, the magazine is moved to the side of the nose section so that the fixing pin is guided into the tapering section and the magazine is fixed to the nose section. In this way, the spring is fixed with being interposed between the nose section and the magazine.

However, when the above spring is used over a long period of time, it fatigues and the elasticity of the spring deteriorates and further the spring breaks. When the spring is replaced to solve the above problems, in order to release the fixing pin attached to the winding end of the spring, it is necessary to separate the magazine from the nose section. Accordingly, it takes time and labor to replace the spring.

As another aspect of a nailing machine, in general, the magazine of a nailing machine is provided for pushing and supplying connected nails, which are charged into the magazine, to a nose section side by a pusher. Therefore, the magazine has a guide path for guiding the connected nails and the pusher which pushes the connected nails onto the nose section side of the nailing machine. This guide path is a common guide means for guiding both the connected nails and the pusher. Therefore, when the connecting nails and the pusher are slid in the guide path, they move in the guide path while they are rubbing an inner wall face of the guide path.

The magazine is usually made of aluminum or aluminum alloy. Therefore, the abrasion resistance and mechanical strength of the magazine are relatively low. On the other hand, the connected nails and pusher, which are made of iron, are subjected to surface treatment. The cost of surface treatment of the connected nails is low, and the mechanical strength of the connected nails is not so high; however, since the pusher is frequently slid in the case of feeding and charging the nails, in order to prevent the pusher from wearing away, the pusher is subjected to quenching. Accordingly, since the surface hardness of the pusher is higher than that of the guide groove, when the pusher frequently slides in the guide groove, the surface of the guide groove is damaged. The thus caused damage becomes a resistance when the nails are fed, which could be a cause of failure of feeding the nails. Consequently, it is necessary to conduct an expensive surface treatment on the magazine.

SUMMARY OF THE INVENTION

The present invention has been accomplished to solve the above problems. That is, a first object of the present invention is to provide a structure for mounting a spring for a pusher of a nailing machine in which the spring for pushing the pusher can be easily replaced.

In order to attain the first object, the present invention provides a structure for mounting a spring for a pusher of a nailing machine in which a straight sheath-shaped magazine is connected with a nose section for driving a nail, and nails connected in a stick-shape are successively supplied into the nose section by a pusher arranged in the magazine, and the nails are driven from the nose section by a driver connected with a piston, wherein a fixing pin is attached to a winding end section of a spring which is attached to the pusher and pushes the pusher in the direction of the nose section; a head portion of the fixing pin is protruded from an opening, the profile of which is tapered to the nose section side on the side of the magazine close to the nose section, and a fixing plate, on which an engaging hole is formed, is engaged with the head portion of the fixing pin from the outside of the opening, and the fixing pin is guided to the tapering section of the opening by moving the fixing plate in the direction of the nose section so as to fix the fixing plate to the nose section.

Further, the second object of the present invention is to provide a structure of a guide for a pusher of a magazine of a nailing machine characterized in that the surface of the guide path of the magazine is seldom damaged even if the magazine is not subjected to surface treatment, the cost of which is especially high.

In order to attain the second object, the present invention provides a structure of a guide for a pusher of a magazine of a nailing machine for guiding the pusher to push connected nails charged into the magazine toward a nose section of the nailing machine, wherein the magazine has a guide groove for guiding a T-shaped top portion formed at an upper end of the pusher and for guiding head portions of the connected nails in an upper portion of a guide path of the pusher and the connected nails, and a cover made of iron is attached to the inside of the guide groove, and the wall thickness of a portion of the pusher passing through the nail guide path is smaller than the diameter of a nail axis portions.

DETAILED DESCRIPTION OF THE PREFERRED EMBODIMENTS

A first embodiment of the present invention is descried in detail with reference to FIGS. 1 to 4.

Figure 1:
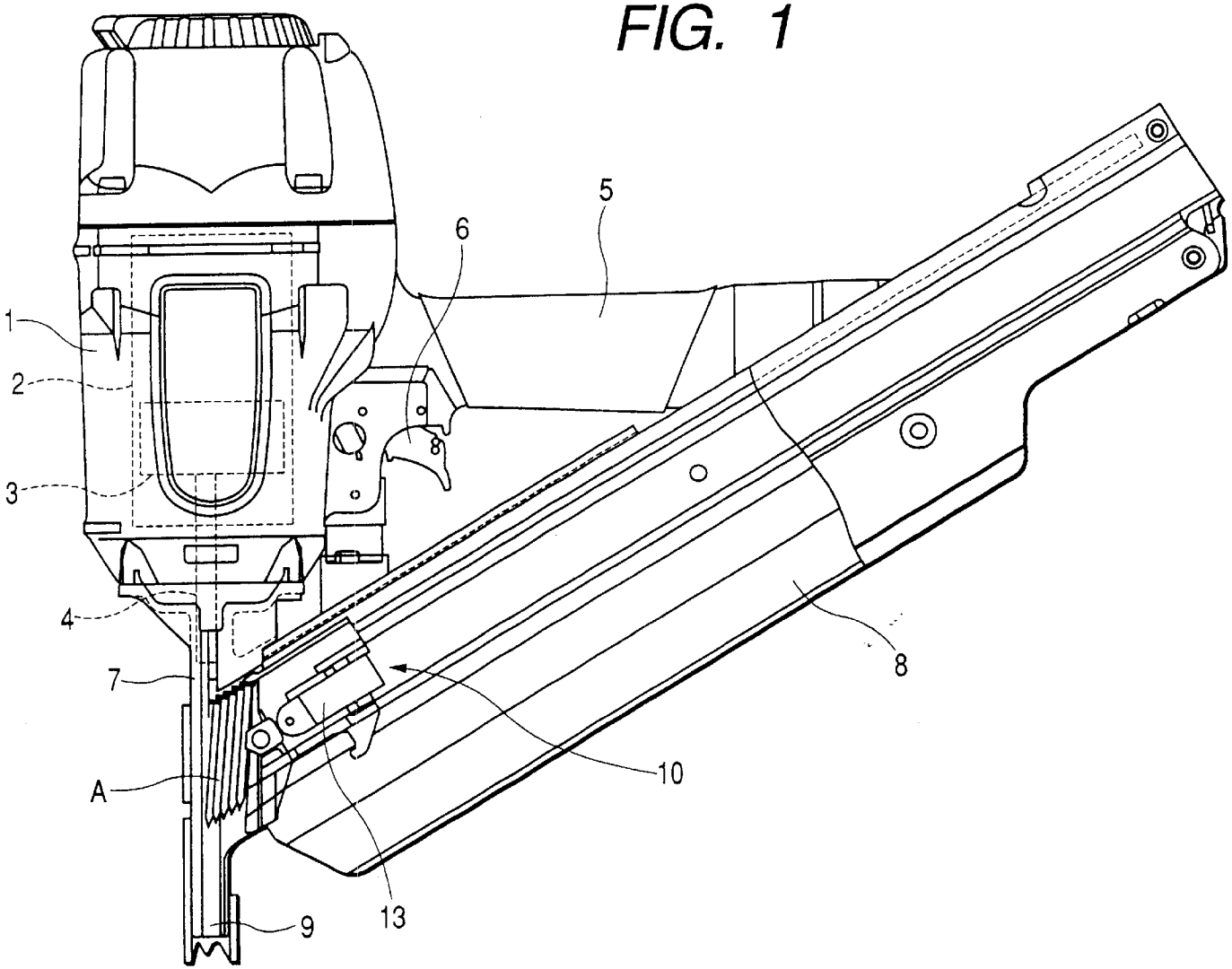
FIG. 1 is a side view of a nailing machine.

FIG. 1 is a view showing a nailing machine of the present invention. In this nailing machine, there is provided a driving cylinder 2 in the body 1. A driving piston 3 moving up and down in the cylinder is integrally connected with a driver 4, and compressed air supplied into a grip 5 is supplied into the cylinder 2, so that the driving piston 3 can be driven. At the forward end of the body 1, there is provided a nose section 7, which is extended from the forward end of the body 1, for slidably guiding the driver 4, and the nose section 7 is provided with a driving port from which nails are driven. On the side of the nose section 7, an end section of a straight sheath-shaped magazine 8 for accommodating connected nails, which are connected with each other being formed into a linear shape, is connected. Therefore, nail A supplied from the magazine 8 is driven from an end of the driving port 9 when it is driven by the driving piston 3.

Figure 2A:
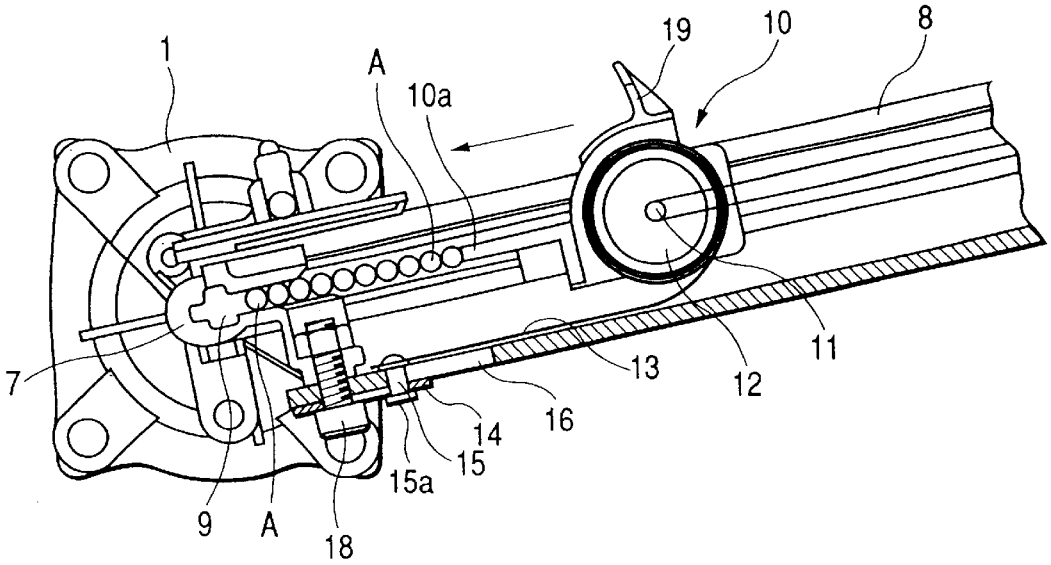
FIGS. 2(*a*) and 2(*b*) are bottom views showing a primary portion which is cut out.
Figure 2B:
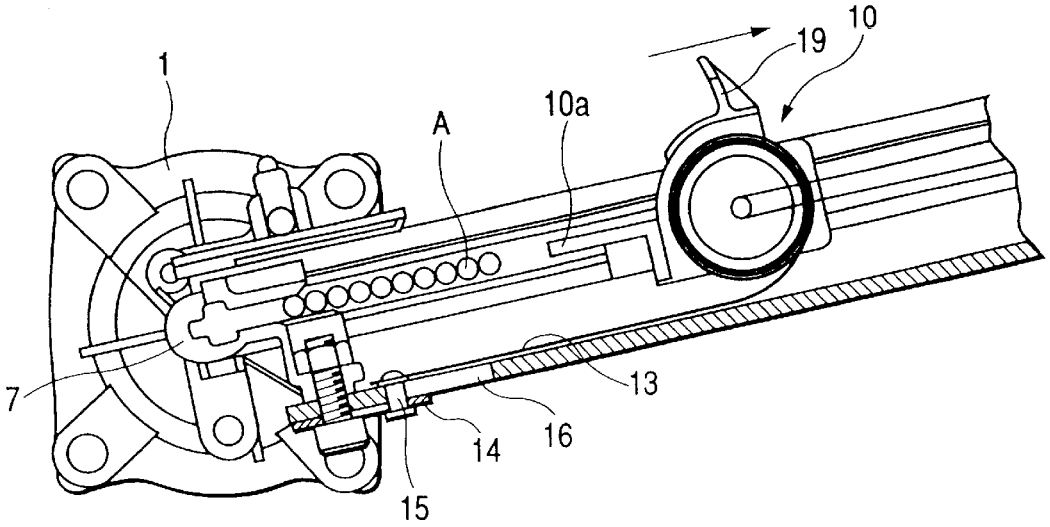

In the above magazine 8, there is provided a pusher 10 for pushing out a nail, which is charged in the magazine 8, into the driving port of the nose section 7. As shown in FIG. 2(*a*), the pusher 10 is slidably arranged in the longitudinal direction of the magazine 8. In a drum 12 pivotally supported by a central shaft 11 of the pusher 10, one end of a spring 13 (spiral spring) at which the spring 13 starts winding is fixed, and the other end at which the spring 13 finishes winding is fixed at the nose section 7 via a fixing plate 14. Therefore, the pusher 10 is always pushed in the direction of the nose section 7 by a returning winding force generated by the spring 13, and nails A accommodated in the magazine 8 can be successively supplied into the driving port 9 of the nose section 7 by a pushing protrusion 10*a* protruded at the end.

A fixing pin 15 is clamped at the end portion of the spring 13 at which the spring 13 finishes winding. A head portion 15*a* of the fixing pin 15 is formed being expanded. The head portion 15*a* of the fixing pin 15 protrudes outside from an opening section 16 formed on the side of the magazine 8.

Figure 3A:
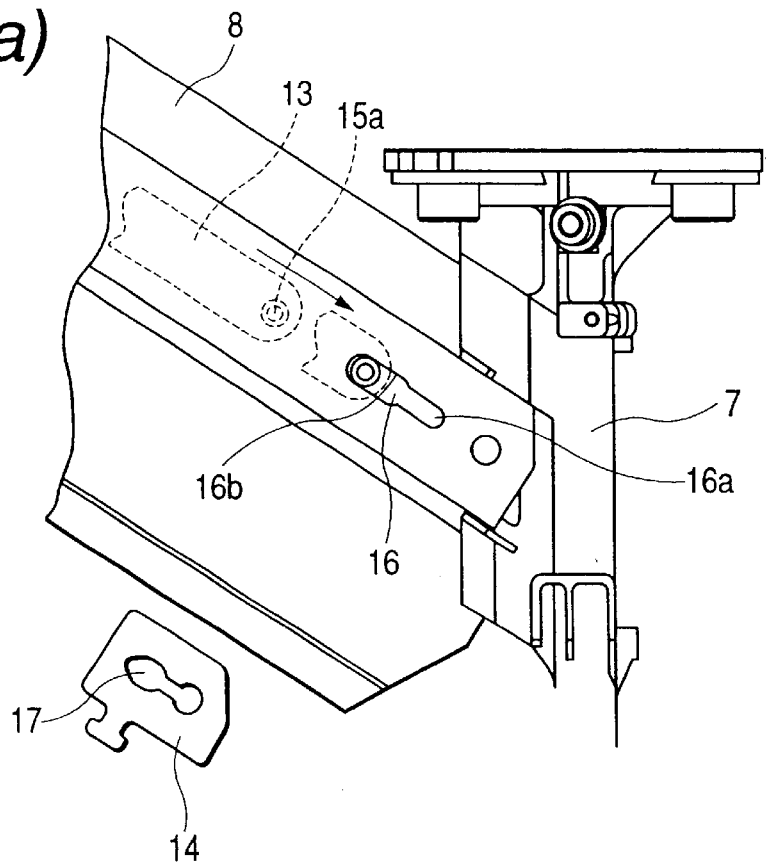
FIGS. 3(*a*) and 3(*b*) are side views for explaining a structure for mounting a spring.
Figure 3B:
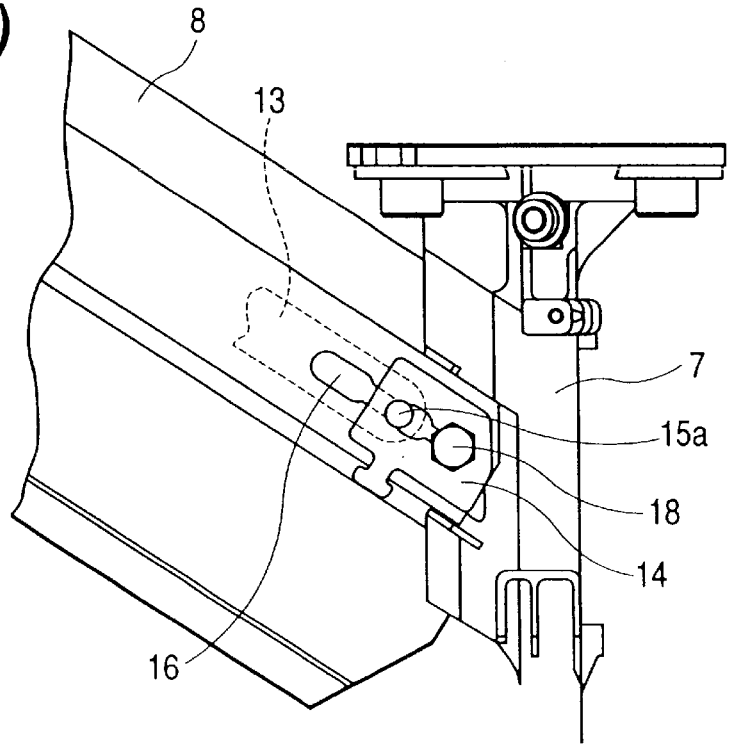

As shown in FIG. 3(*a*), the opening 16 is formed into a tapering shape in which the width of a forward end toward the nose section 7 is narrower than the width of a rear end off the nose section 7. The width of the tapering section 16*a* is narrower than the width of the head portion 15*a* of the fixing pin 15. The wide width section 16*b* is wider than the width of the head portion 15*a* of the fixing pin 15. Therefore, when the fixing pin 15 protruding from the wide width section 16*b* is guided into the tapering section 16*a*, the head portion 15*a* of the fixing pin 15 is caught by the tapering section 16*a*. Therefore, the fixing pin 15 can not be pulled out.

As shown in FIG. 3(*a*), the fixing plate 14 is a metallic sheet member on which an engaging hole 17 is formed so that the head portion 15*a* of the fixing pin 15 can penetrate the engaging hole 17. The fixing plate 14 is fixed to the nose section 7 with a bolt 18. While the head portion 15*a* of the fixing pin 15 is protruded from the engaging hole 17, the fixing plate 14 is moved in the direction of the nose section 7, so that an axial section of the fixing pin 15 is guided into the tapering section 16*a* of the opening 16. While the axial section is contacted with a forward end of the tapering section 16*a* of the opening 16, the bolt 18 is screwed to the nose section 7 so as to fix the fixing pin 15. Due to the foregoing, the end portion of the spring 13 at which the spring 13 finishes winding can be fixed to the magazine 8. (See FIG. 3(*b*))

An operation lever 19 is arranged on the side of the pusher 10 in such a manner that the operation lever 19 protrudes outside the magazine 8. When the operation lever 19 is pulled backward resisting a force of the spring 13, the pushing of nails A can be released as shown in FIG. 2(*b*).

Figure 4A:
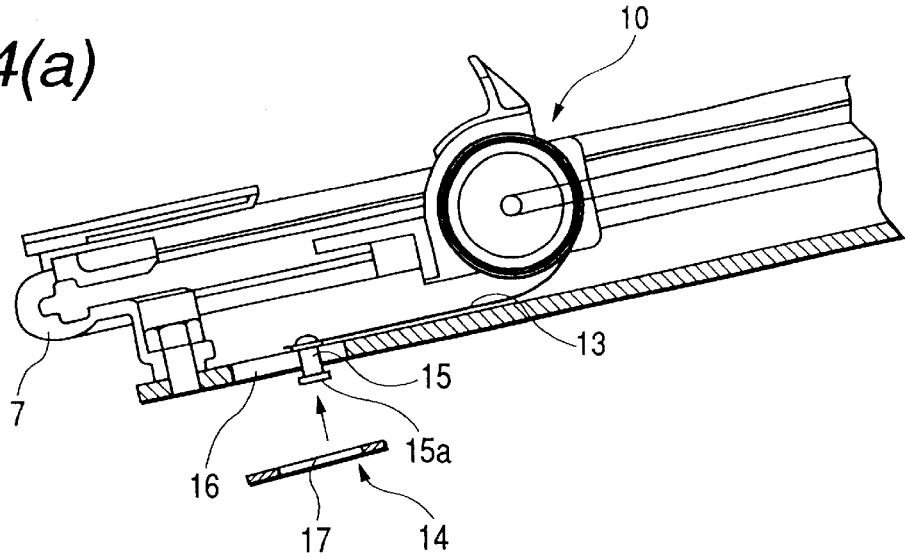
FIGS. 4(*a*), 4(*b*) and 4(*c*) are views for explaining forms for fixing a spring.
Figure 4B:
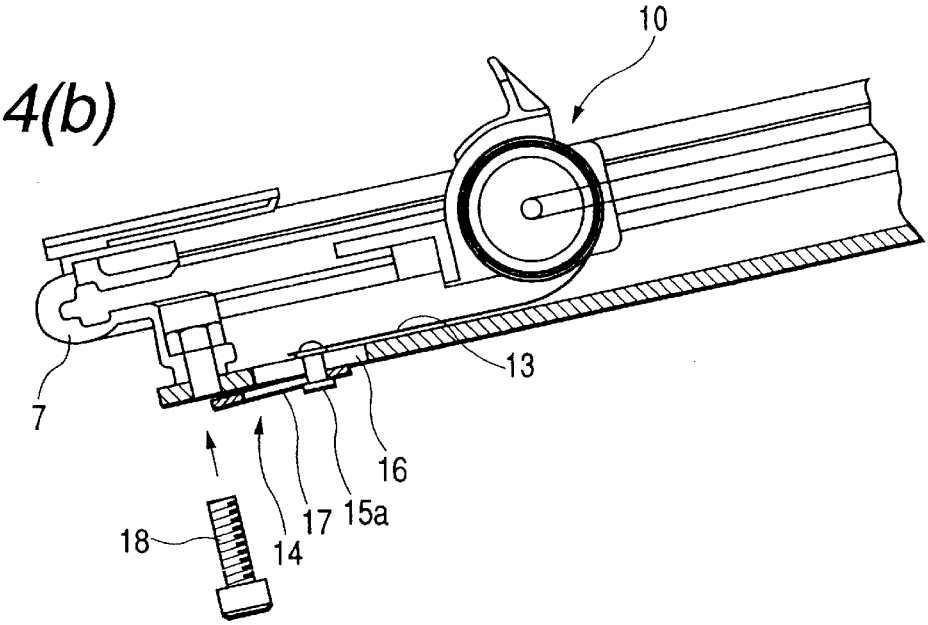
Figure 4C:
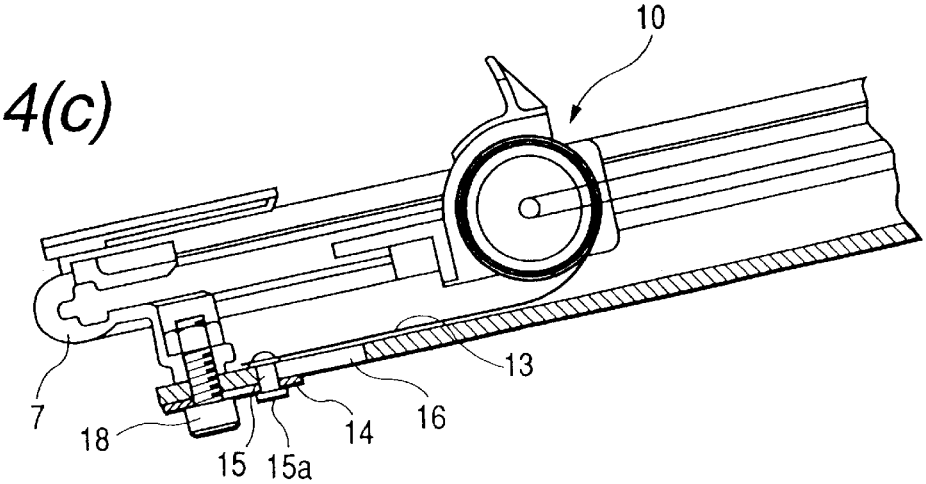

According to the structure for mounting a spring described above, the winding end of the spring 13 is fixed to the magazine 8 in the following manner. As shown in FIG. 4(*a*), the head portion 15*a* of the fixing pin 15, which is clamped at the winding end, is protruded outside from the wide width section 16*b* of the opening 16 of the magazine 8. Then, as shown in FIG. 4(*b*), the head portion 15*a* of the fixing pin 15, which is protruded outside from the opening 16, is engaged with the engaging hole 17 of the fixing plate 14 from the outside of the magazine 8. While the head portion 15*a* is protruded from the engaging hole 17, the fixing plate 14 is moved toward the nose section 7, so that the axial section of the fixing pin 15 is guided until it comes into contact with the forward end of the tapering section 16*a* of the opening 16, and the fixing plate 14 is fixed to the nose section 7 with the bolt 18. (See FIG. 4(*c*).)

In the case where something is wrong with the spring 13, the bolt 18 is detached so as to release the fixing plate 14, and the fixing pin 15 is moved from the tapering section 16*a* of the opening 16 to the wide width section 16*b*. Due to the foregoing, the fixing pin 15 can be released. In this way, the spring 13 can be released without detaching the magazine 8. Therefore, the spring 13 can be easily replaced.

According to the first embodiment of the present invention, when something is wrong with the spring of the pusher and it becomes necessary to replace the spring, it is possible to release the spring only when the bolt for fixing the fixing plate is disconnected. Therefore, it is unnecessary to take the magazine apart into pieces, and it is possible to replace the spring easily. Accordingly, any problems are avoided when the spring is replaced.

Next, a second embodiment of the present invention is descried in detail with reference to FIGS. 5 to 8.

Figure 5:
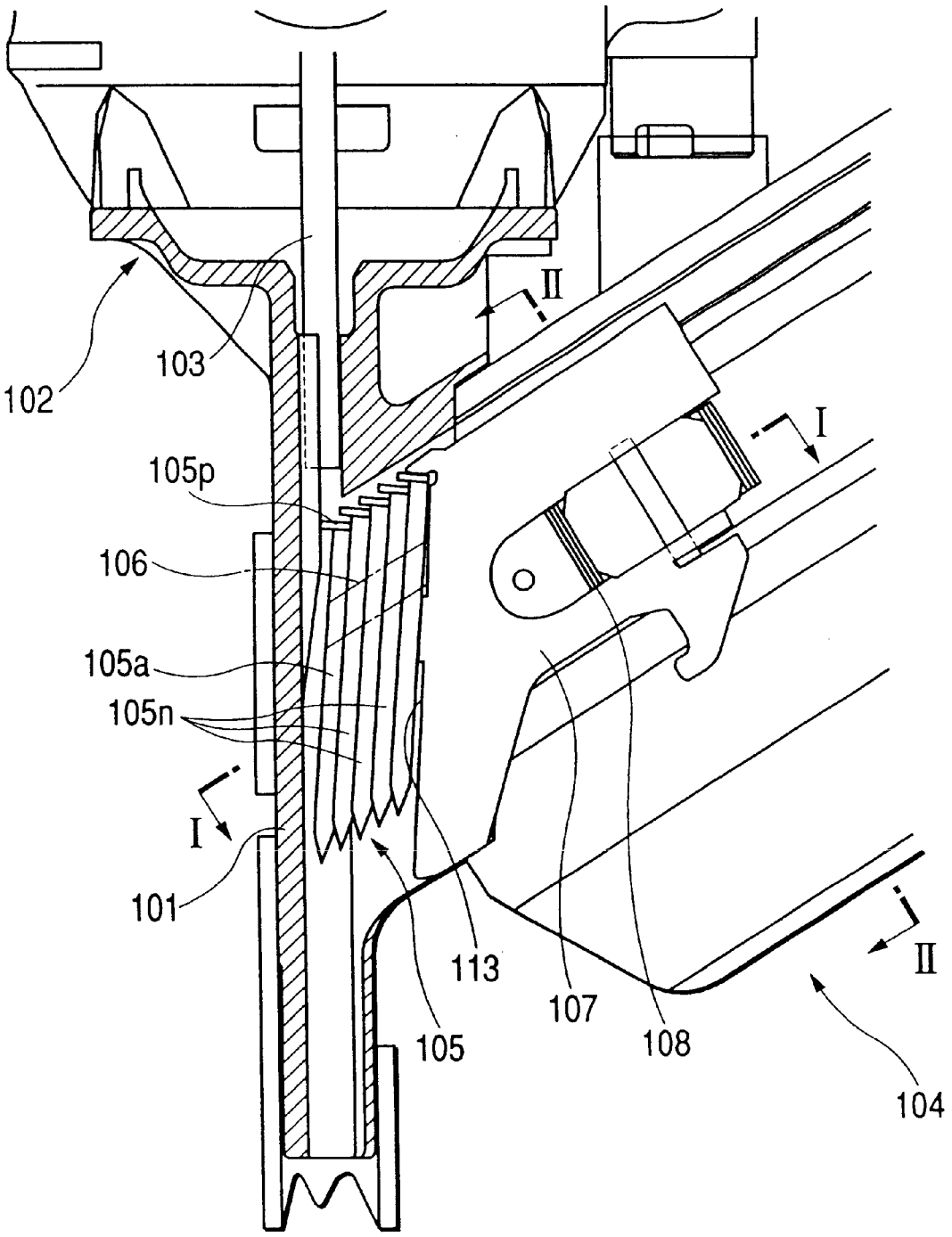
FIG. 5 is a longitudinal cross-sectional view showing a periphery of a nose section of a nailing machine.

Reference numeral 101 shown in FIG. 5 is a nose section of a nailing machine. The nose section 101 is a cylindrical member extending to a lower portion of the nailing machine body 102. The nose section 101 guides a sliding motion of the driver 103 which is driven by a driving mechanism (not shown) provided in the nailing machine body 102. At the same time, the nose section 101 opens to a forward end of the magazine 104 and accommodates the lead nail 105*a* of connected nails 105 which are charged into the magazine 104. The lead nail 105*a* driven by the driver 103 can be guided by the nose section 101 in the direction of driving.

The connected nails 105 are composed in such a manner that a large number of nails 105*n* are connected with each other and formed into a stick-shape via the connecting member 106. The connected nails 105 are connected with each other while the head portions 105*p* of the nails 105*n* are being superposed on each other. The connecting member 106 is made of synthetic resin, wire or paper. The connected nails 105, which are charged into the magazine 104, are a little tilted with respect to the nose section 101. The connected nails 105 are not limited to the above eccentric nails, but it is possible to use nails, the head portions of which are circular and superposed on each other with being connected with each other via the connecting member.

In the magazine 104, there is provided a pusher 107. The pusher 107 pushes forward the connected nails 105 at all times by a force of the constant output spring 108, so that the connected nails 105 can be supplied to the nose section 101.

Figure 6:
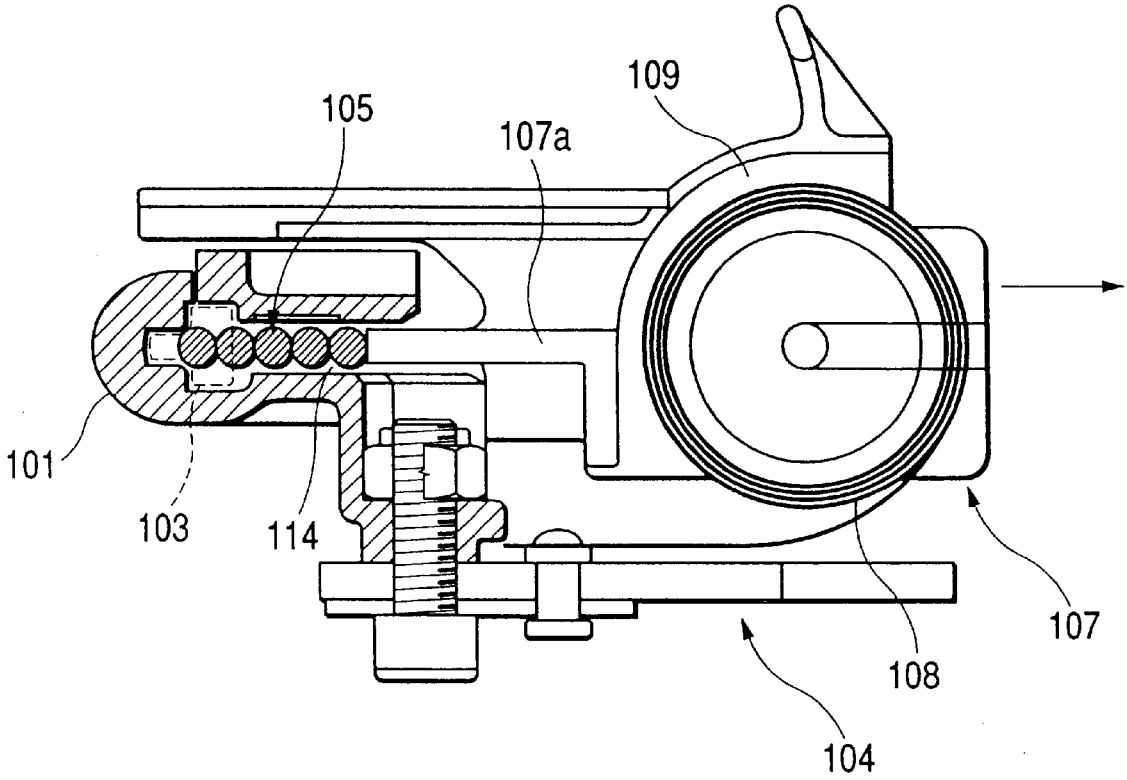
FIG. 6 is a cross-sectional view taken on line I—I in FIG. 5.
Figure 7:
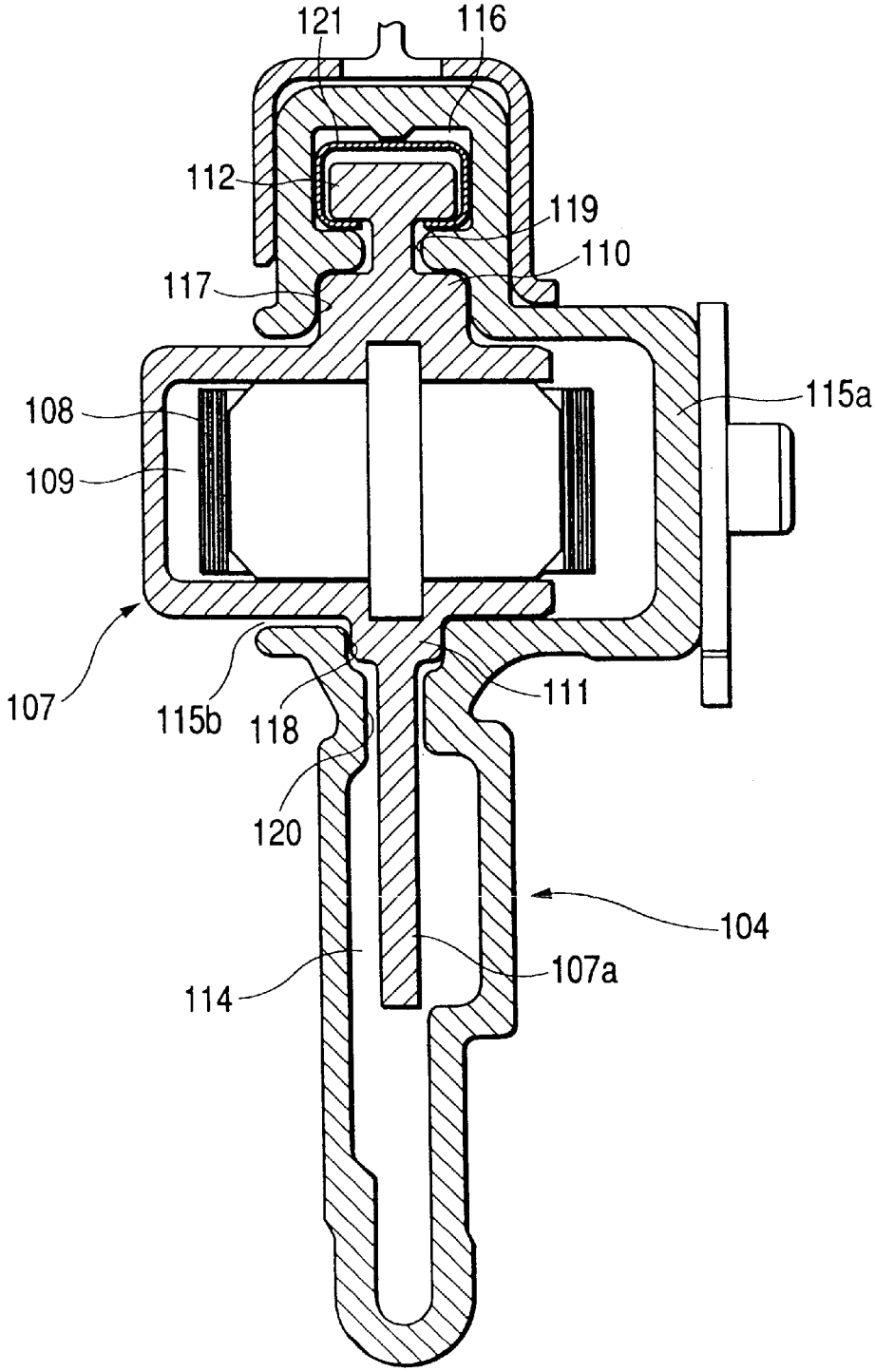
FIG. 7 is a cross-sectional view taken on line II—II in FIG. 5.

As shown in FIGS. 6 and 7, at a central rear portion of the plate-shaped pushing section 107*a*, there is provided a box-shaped accommodating section 109 for accommodating a constant output spring 108. At an upper portion of the box-shaped accommodating section 109, there is provided an upper protrusion 110, and at a lower portion of the box-shaped accommodating section 109, there is provided a lower protrusion 111. At an upper end of the pushing section 107*a*, there is provided a T-shaped top section 112, the cross section of which is a T-shape. The front end face 113 (shown in FIG. 5) of the pushing section 107*a* is formed into an inclined face, the inclination of which is the same as that of the connected nails 105 charged into the magazine 104. The wall thickness of the pushing section 107*a* is smaller than the diameters of the nail axis portions of the connected nails 105. One end of the above constant output spring 108 is fixed to a front end portion of the magazine 104.

At the center of the magazine 104, there is provided a guide path 114 for slidably guiding the connected nails 105 and pusher 107 in the longitudinal direction. On one side wall of the intermediate section of the guide path 114, there is provided an expanding section 115*a* which expands to the side so that the box-shaped accommodating section 109 of the pusher 107 can be accommodated in it. On the other side wall, there is provided an opening 115*b* so that the box-shaped accommodating section 109 can be exposed to the side. In an upper portion of the guide path 114, there is provided a guide groove 116 for guiding the T-shaped top section 112 of the pusher 107 and the nail head portions 105*p* of the connecting nails 105, that is, the upper portion of the guide path 114 is formed into a groove-shape. In an upper portion and a lower portion of the portion in which the box-shaped accommodating section 109 is accommodated, there are provided throttled sections 119, 120, the width of which is narrow, which are formed via the recesses 117, 118 receiving the protrusions 110, 111 of the pusher 107. A width of both the throttled sections 119, 120 is set at a value a little larger than the diameters of the nail axis portions of the connected nails 105.

A cover 121 made of iron is installed inside the above guide groove 116. The cover 121 is arranged over the entire length of the guide groove 116.

According to the above structure, the nail head portions 105*p* of the connected nails 105 charged in the magazine 104 and the T-shaped top section 112 of the upper end of the pusher 107 are engaged with the guide groove 116, and the nail axis portions of the connected nails 105 and the pusher 107 are accommodated in the guide path 114, and further the box-shaped accommodating section 109 of the pusher 107 is accommodated inside the expanding section 115*a*. In this case, concerning the connected nails 105 and the pusher 107, the nail head portions 105*p* and the T-shaped top section 112 are hung down with being engaged with the guide groove 116. Since the magazine 104 is open to the nose section 101, the lead nail 105*a* of the connected nails 105 is pushed by the pusher 107 and supplied to the nose section 101. Therefore, when the driving mechanism is operated, the lead nail 105*a* in the nose section 101 is driven by the driver 103 and shot out from the nose section 101. When the driver 103 returns to the initial position, the next lead nail is sent to the nose section 101. In the case of supplying the nails, the pusher 107 and the connected nails 105 are slid in the magazine 104.

Figure 8:
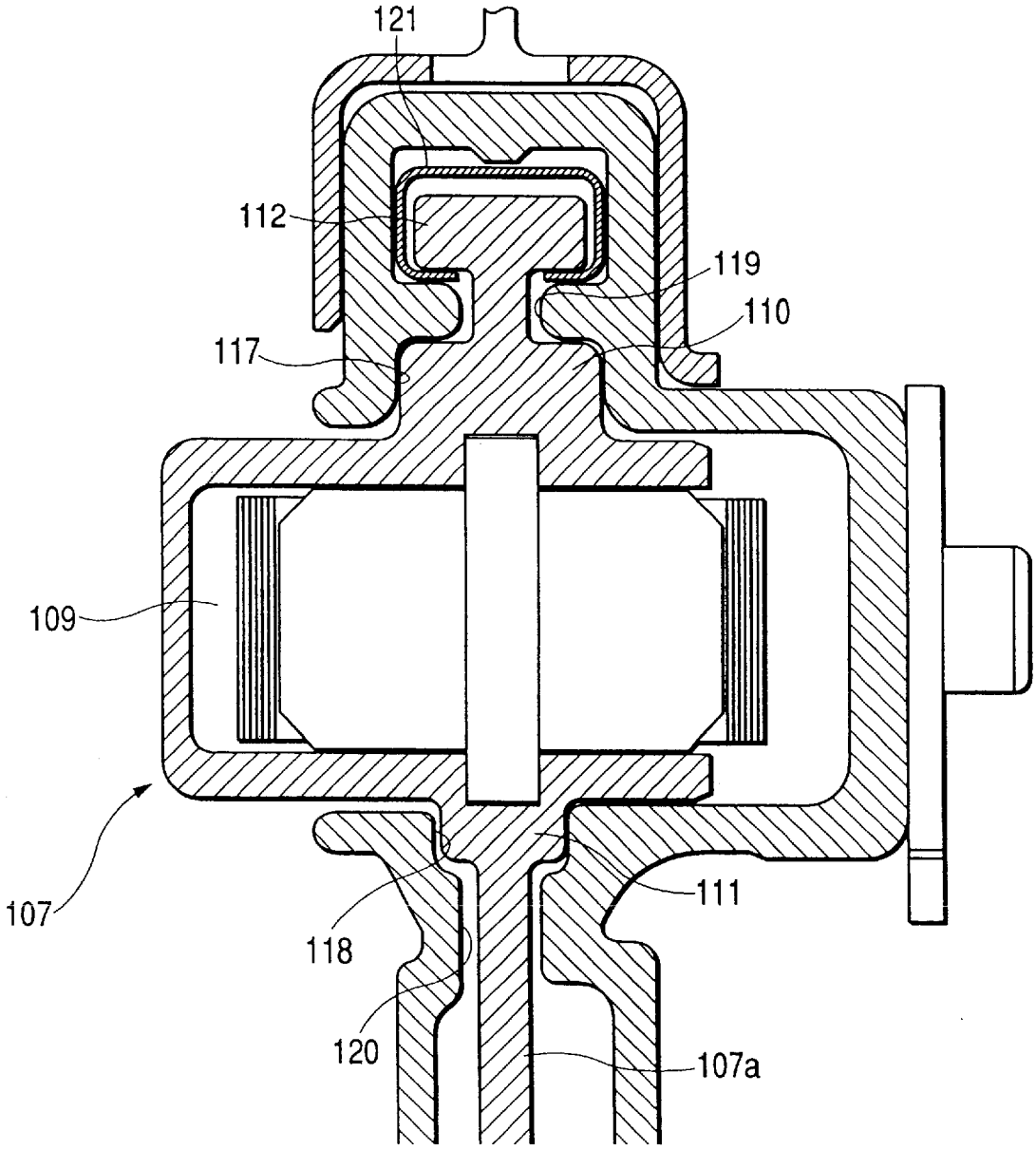
FIG. 8 is an enlarged view of FIG. 7.

When the pusher 107 and the connected nails 105 slide in the magazine 104, as shown in FIG. 8, the nail heads and the T-shaped top section 112 of the pusher 107 come into contact with the cover 121 made of iron, the abrasion resistance of which is high. Therefore, the nail heads and the T-shaped top section 112 of the pusher 107 slide smoothly and seldom damage. Accordingly, even when the device is used over a long period of time, the performance of feeding the connected nails 105 seldom deteriorates.

The protrusions 110, 111 of the pusher 107 are engaged with the inner side walls of the recesses 117, 118 of the magazine 104, so that deviation of the pusher 107 to the side can be prevented. The wall thickness of the pushing section 107*a* of the pusher 107 is smaller than the diameters of the nail axis portions of the connected nails 105. A width of the upper and the lower throttled sections 119, 120 of the portion in which the box-shaped accommodating section 109 of the pusher 107 is accommodated is set at a value a little higher than the diameters of the nail axis portions of the connected nails 105. Accordingly, in the case of sliding, the nail axis portions of the connected nails 105 come into contact with the inner side faces of the throttled sections 119, 120; however, the pushing section 107*a* of the pusher 107 do not come into contact with the same.

In the case of sliding, there is a possibility that the protrusions 110, 111 of the pusher 107 come into contact with the inner walls of the recesses 117, 118. However, the pusher 107 itself is hung from the guide groove 116. Therefore, when the pusher 107 itself is hung from the guide groove 116, even if the protrusions 110, 111 come into contact with the inner side walls of the recesses 117, 118 of the magazine 104, the contacting forces are so weak that the inner side walls of the recesses 117, 118 are not damaged. In the case where the connected nails 105 come into contact with the inner sides of the throttled sections 119, 120, the circumstances are the same. Even if the nail axis portions of the connected nails 105, which are hung from the guide groove 116, come into contact with the throttled sections 119, 120, the throttled sections 119, 120 are seldom damaged.

As described above, when the cover 121 made of iron, the cost of which is not high, is attached inside the guide groove 116, sliding can be conducted more smoothly, and the performance of feeding the connected nails 105 can be enhanced. Further, since the guide groove 116 is seldom damaged, it is unnecessary to conduct an especially expensive surface treatment on the magazine 104.

While only a certain embodiment of the invention has been specifically described herein, it will be apparent that numerous modifications may be made thereto without departing from the spirit and scope of the invention.

What is claimed is:

1. A spring mount for a pusher of a nailing machine in which a straight sheath-shaped magazine is connected with a nose section for driving a nail, and nails connected in a stick-shape are successively supplied into the nose section by a pusher arranged in the magazine, and the nails are driven from the nose section by a driver connected with a piston, wherein a fixing pin is attached to a winding end section of a spring attached to the pusher and pushing the pusher in the direction of the nose section, and a head portion of the fixing pin is protruded from an opening, the profile of which is tapered to the nose section side of the side of the magazine close to the nose section, and a fixing plate, on which an engaging hole is formed, is engaged with the head portion of the fixing pin from the outside of the opening, and the fixing pin is guided to the tapering section of the opening by moving the fixing plate in the direction of the nose section so as to fix the fixing plate to the nose section.

* * * * *